United States Patent [19]

Gallaro

[11] Patent Number: 4,555,993

[45] Date of Patent: Dec. 3, 1985

[54] WATER GAS FURNACE

[76] Inventor: Carmelo Gallaro, 490 Henry St., Brooklyn, N.Y. 11231

[21] Appl. No.: 619,473

[22] Filed: Jun. 11, 1984

[51] Int. Cl.[4] ..... F23B 7/00

[52] U.S. Cl. ..... 110/234; 110/347; 122/4 D; 122/5; 122/15; 122/22; 122/28; 122/158; 122/367 PF

[58] Field of Search ..... 110/233, 234, 268, 347; 122/5, 15, 22, 28, 4 D, 367 PF, 155 R, 158; 431/7, 170; 126/344

[56] References Cited

U.S. PATENT DOCUMENTS

| | | | |
|---|---|---|---|
| 645,131 | 3/1900 | Robbins | 110/234 |
| 1,594,127 | 7/1926 | Slater et al. | 110/234 |
| 1,857,024 | 5/1932 | Hulme | 122/28 |
| 2,151,516 | 3/1939 | Johnson | 122/158 |
| 3,785,304 | 1/1974 | Stookey | 110/234 |
| 4,387,669 | 6/1983 | Brown | 122/15 |

FOREIGN PATENT DOCUMENTS

| | | | |
|---|---|---|---|
| 2513354 | 3/1983 | France | 122/5 |
| 1859 | of 1870 | United Kingdom | 110/268 |

*Primary Examiner*—Albert J. Makay
*Assistant Examiner*—Steven E. Warner
*Attorney, Agent, or Firm*—Goodman & Teitelbaum

[57] ABSTRACT

A water gas furnace comprising an outer container to provide a housing in which coke is placed into its lower part. A water container is placed within the housing. The coke is ignited and heats the water in the container converting it into steam. The steam is ejected into the coke, which together with air, produces water gas. Preferably, pumice stones are placed above the coke. The water gas is accepted into the pores of the pumice stones, where the heated pumice stones ignite the water gas, producing heat. The heat is extracted by a heat exchanger provided about the housing.

12 Claims, 1 Drawing Figure

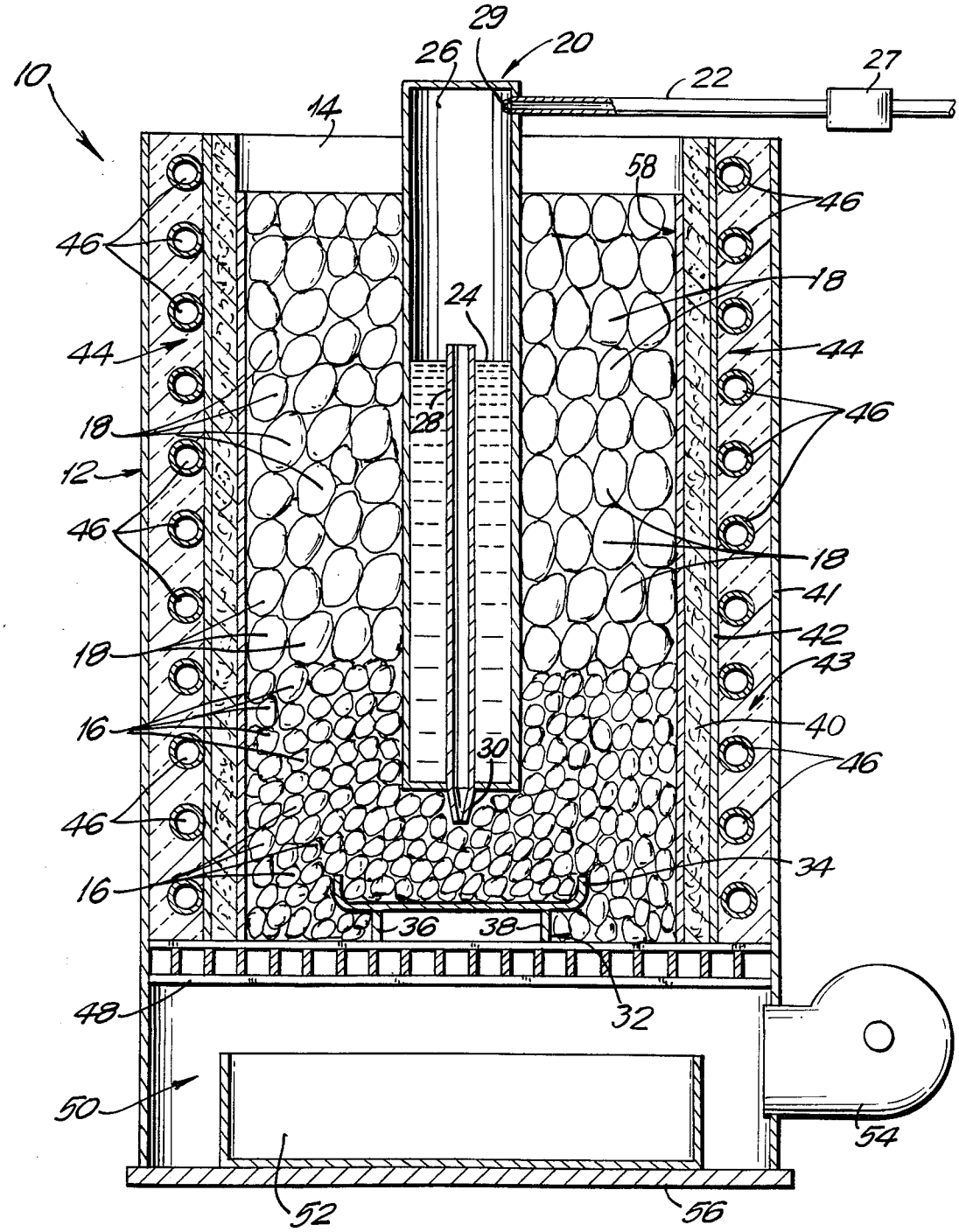
10
14
29
26
20
22
27
58
46
46
18
24
44
44
28
46
18
12
46
18
41
42
18
43
16
40
30
46
46
34
16
36
38
48
32
50
54
52
56

WATER GAS FURNACE

BACKGROUND OF THE INVENTION

This invention relates to a water gas furnace, and more particularly to a method and apparatus for producing water gas from carbonaceous material, and then utilizing the water gas for the production of heat energy which can be extracted for further use.

Furnaces are generally utilized for converting a fuel in the production of heat energy, the fuel being converted into a waste material. Numerous types of furnaces are available which use various forms of fuels. One type of readily available furnace is a coal furnace which burns the coal in the presence of air to thereby produce various gases, the gases generally being ejected through a flue as smoke. The remainder of the coal is converted into an ash which is generally discarded. During the combustion of the coal, heat energy is produced which is extracted for external use.

Such coal furnaces are generally inefficient, since most of the by-products of the coal are blown away into the air or are discarded as ash. Accordingly, such furnaces have very limited use.

It is also well known to convert coal or coke into various forms of gas, wherein the gas can be utilized for further commercial use. One well known process for the production of such gas permits the carbon in the coal or coke to decompose in the presence of steam, thereby producing hydrogen and carbon monoxide. Air is typically blown into the system in order to raise the temperature of the fuel bed. The gas produced is generally referred to as water gas, and such water gas is extracted and stored for subsequent use in other energy producing equipment.

The production of the water gas is also somewhat inefficient, since a large amount of heat is lost in the production of the water gas, and the inability to effectively utilize the water gas in its heated state also reduces the efficiency of the process.

SUMMARY OF THE INVENTION

Accordingly, it is an object of the present invention to provide an effective furnace utilizing water gas as a fuel.

Another object of the present invention is to provide a furnace which both generates the water gas and also utilizes the water gas for the production of heat energy.

Another object of the present invention is to provide an efficient water gas generator, with the water gas then serving as a fuel in the production of heat energy which can be extracted for external use.

Still another object of the present invention is to provide a furnace which generates water gas and stores the water gas in a reusable material, such that the heat energy obtained from the water gas can be extracted while simultaneously permitting the water gas to burn as a fuel.

Yet another object of the present invention is to provide a water gas furnace utilizing pumice stones to store the heated water gas in its pores, and igniting the water gas stored in the pumice stone pores to permit the extraction of heat energy during the combustion of the heated water gas.

Briefly, in accordance with the present invention, there is provided a water gas furnace having an outer containment vessel which houses an outer chamber. In the outer chamber, a lower layer of carbonaceous material is placed, such as coal or coke. Above this lower layer is placed a layer of pumiceous material, such as pumice stones. A sheet steel cylinder is disposed about the upper and lower layers of material.

An inner container or chamber is situated within the outer chamber and extends downwardly into the lower carbonaceous layer. An inlet is coupled to the inner container for supplying water into the inner container. An outlet extends from the inner container into the carbonaceous material for supplying steam from the container. The combustion of the carbonaceous material serves to heat the water in the container, thus converting the water into steam. An air supply feeds into the outer chamber to provide air, as needed, to the coke and steam combustion.

The combustible reaction of the carbonaceous material with the steam and air is aided by a catalyst, such as the steel of the sheet steel cylinder, to produce the water gas. The water gas moves into the pores of the pumiceous material. The heat from the water gas serves to heat the pumiceous material, thus causing the water gas to ignite. The water gas burns in the pumiceous material producing heat energy which is extracted through a heat exchanger. Although the carbonaceous material is relatively quickly used up, the pumiceous material remains for a long period of time, even for use.

The aforementioned objects, features and advantages of the present invention will, in part, be pointed out with particularity, and will, in part, become obvious from the following more detailed description of the present invention taken in conjunction with the accompanying drawing, which forms an integral part thereof.

BRIEF DESCRIPTION OF THE DRAWING

The single FIGURE of the drawing schematically shows a vertical cross sectional view through the furnace of the present invention.

DESCRIPTION OF THE PREFERRED EMBODIMENT

The furnace of the present invention is shown generally at 10 and includes an outer containment vessel 12 formed of metal, brick, etc., which provides an outer housing for the furnace 10. Typically, the housing can be a cylindrical container. The containment vessel 12 encloses outer chamber 14 serving as the combustion chamber. The combustion chamber 14 is open at the top thereof, as shown in the drawing. Placed in the lower part of the combustion chamber 14 is a layer of carbonaceous material 16, such as coal or coke. Above the lower layer 16 is placed a layer of pumiceous material 18, such as pumice stones. Such pumice stones are a well known material, where there is a high ratio of pores in the material itself.

An inner container 20 is positioned within the outer chamber 14 and extends through the pumiceous material 18 and at least partway into the carbonaceous material 16. An inlet tube 22 serves as an input water line to provide water 24 for storage in an inner chamber 26 defined inside the container 20. A suitable water meter and valve arrangement 27 can be provided in the water line 22 to control the rate of flow of the water through the nozzle 29 into the inner chamber 26.

An outlet tube 28 is disposed in the inner chamber 26 and extends downwardly through the lower end of the container 20 to provide a steam ejector nozzle 30 directed into the carbonaceous material 16.

Spaced beneath the steam ejector nozzle 30 is a steam deflector 32 formed as a U-shaped tray 34 supported by support members 36, 38. The steam deflector 32 can be formed of iron material, or the like. Steam ejected from the nozzle 30 will hit the deflector 32 and spread into the carbonaceous material 16.

Surrounding the outer chamber 14 is a layer of fire resistant dolomite material 40 forming a liner about the chamber 14. The containment vessel 12 has outet and inner cylindrical spaced apart walls 41 and 42 to provide an outer cylindrical compartment 43 in which is placed insulation material 44. Appropriate water pipes 46 are embedded in the insulation material 44 against the inner wall 42 to serve as a heat exchanger to extract the heat produced by the furnace 10 and to permit utilization of the heat for area heating, hot water and other like purposes. Such heat exchangers are well known in the art.

Beneath the carbonaceous material, there is provided a metal grating 48 through which the ash from the carbonaceous material can fall into a lower compartment 50 of the containment vessel 12. An open ash clean out compartment 52 can be provided to catch the falling ash to permit collection of the ash from the lower compartment 50. A conventional air pump 54 is connected to the containment vessel 12 to provide a flow of air into the combustion chamber. The containment vessel 12 and the ash clean out compartment rest on a bottom plate 56.

A cylinder 58 of sheet steel is disposed between the layers 16, 18 of carbonaceous and pumiceous materials on one side and the layer 40 of dolomite material on the other side to provide a catalyst for the combustible reaction, as set forth below.

The coal, coke, or the like is placed into the bottom portion of the outer chamber 14 to form the layer 16. The coke is ignited through the use of wood, gas, or the like, so as to start the coke burning. The water can either be previously supplied into the inner chamber 26, as shown in the drawing, or can be added after the coke has been ignited. The coke turns a cherry red condition of approximately 1,000 degrees Farenheit and the water within the inner container 26 begins to turn to steam. The steam is ejected from the lower nozzle 30 into the ignited carbonaceous material so as to cause a disassociation process producing the water gases. As is well known, the use of the air is provided so as to maintain the continuous production of the water gas at a high temperature range.

The decomposition of steam by red-hot iron is well known, having been first studied by H. St. C. Deville. Thus, the sheet steel cylinder 58, approximately one sixteenth of an inch thick, is placed between the dolomite material layer 40 and the fuel material to provide a catalyst for the final disassociation of the oxygen and hydrogen gases resulting from the immersion of the steam into the hot bed of carbonaceous and non-carbonation material. As the temperature reaches the above mentioned 1,000 degrees Farenheit, the cylinder 58 also turns a cherry red, wherein the molecules in the sheet steel of the cylinder 58 become unstable and fluid. In this condition, the molecules of the cylinder 58 readily absorb the oxygen gas resulting from the disassociation of the steam, where the evidence of this process can be seen by a ferris oxide slag that coats the walls of the cylinder 58. Accordingly, the hydrogen gas is now left free to be burnt as a fuel within the furnace 10 during the operation thereof.

The pumiceous material 18, such as the pumice stone, can either be added at the beginning of the process, or can be inserted after the coke is already burning. The water gas that is produced can now flow into the pumice stones and be accepted within the pores of the pumice stones so as to heat up the pumice stones. The hot pumice stones cause the hot water gases to ignite, which in turn continues to heat up the pumice stones. The heat from this cyclic process is extracted by the water pipes 46 serving as a heat exchanger. The layer 40 of dolomite material serves as a high heat resistance material, as does the insulation material 44 surrounding the water pipes 46.

It has been found, that anthracite coal refuse can be burned in the furnace 10 of the present invention, by replacing part or all of the pumiceous material with the anthracite coal refuse. Likewise, the furnace 10 of the present invention could also burn other normally considered "waste" products, such as petroleum coke and low-grade oil shale or shale residue, as well as higher quality fuels such as bituminous and subituminous coal.

Anthracite coal refuse is generally considered to be anthracite culm, which is a rock-laden waste left behind when anthracite is mined and the higher-quality coal is separated out. More than 150 years of anthracite mining in the state of Pennsylvania, where nearly all of the nation's anthracite is located, has left an estimated 900 million tons of culm which has an energy equivalent of more than one billion barrels of oil.

In an embodiment of the present invention, an outer container was utilized which formed an inner combustion chamber having a diameter of approximately 14 inches. A one inch liner of dolomite material was utilized with a three inch thickness of insulation material surrounding the dolomite layer. The inner water container had a diameter of 4 inches with the inlet water line having a ½ inch diameter and the outlet tube having a ¾ inch diameter. Coke was filled into the chamber to a height of about 10 inches with the pumice stones filling approximately 20 inches. As the coke material was used up, the ash thereof (if any) passed downwardly through the grating into the lower compartment, and the pumice stones dropped down to fill the area of the coke material. The pumice stones were held in place by the grating. The air pump was a ¼ horsepower motor having a 3 inch diameter outlet into the furnace. The inlet nozzle provided an intermittent flow of water at approximately 1.35 gallons per hour with the flow being turned on for 30 seconds and off for 15 minutes. A continuous flow of water could also have been utilized. If desired, a conventional hood and flue could be mounted over the furnace in a manner well known in the art.

The furnace was found to be extremely efficient. The water gas itself enriches the environment in the combustion chamber about the coke material, thus resulting in the complete combustion of the coal or coke. As a result, the ashes produced were extremely small, about the size of coffee grounds. The BTU of the coal and/or coke are approximately 2–3 times the normal BTU rating of such coke in water gas production. This results in a much hotter and longer lasting operation with increased efficiency. There was very little, if any, carbon deposit or other residue, which would typically show a poor deficiency.

The present furnace provided a longer period of operating time with a very clean emission and with no carbon residues. The amount of steam produced and sent into the carbonaceous material must be regulated so as to prevent any cooling of the combustible material. This would otherwise prevent non-disassociated steam from escaping through the flues. By closely monitoring the steam, the furnace can run for greater periods of time. Care must be taken that the steam emissions from the inner vessel should always be directed into the combustible carbonaceous material.

There has been disclosed heretofore the best embodiment of the invention presently contemplated. However, it is to be understood that various changes and modifications may be made thereto without departing from the spirit of the invention.

What is claimed is:

1. A water gas furnace comprising:

a containment vessel defining an outer chamber for housing a layer of carbonaceous material;

an inner chamber disposed within said containment vessel and extending into said layer;

inlet means coupled to said inner chamber for supplying a flow of water to said inner chamber;

outlet means coupled to said inner chamber for supplying steam into the outer chamber, the steam resulting from heating the water in the inner chamber through combustion of the carbonaceous material;

air supply means coupled to said outer chamber so that a combination of the steam and air in the combustion of the carbonaceous material produces oxygen and hydrogen gases to define a water gas which ignites and continues to heat the furnace; and iron means to provide a catalyst for disassociation of the oxygen and hydrogen gases, said iron means absorbing the oxygen gas to free the hydrogen gas to burn as a fuel within the furnace;

said iron means including a cylinder of sheet steel disposed about said layer of carbonaceous material.

2. A water gas furnace as in claim 1, including a lower compartment below said outer chamber for receiving any ash resulting from the combustion of the carbonaceous material, a grating is disposed on top of said lower compartment through which the ash can fall.

3. A water gas furnace as in claim 1, including means for igniting said water gas, said igniting means being a layer of pumiceous material disposed in said outer chamber above said layer of carbonaceous material.

4. A water gas furnace as in claim 1, and comprising a fire resistant dolomite liner in said containment vessel bounding said outer chamber.

5. A water gas furnace as in claim 1, and comprising a steam deflector spaced with respect to said outlet means for spreading the steam to the carbonaceous material.

6. A water gas furnace as in claim 1, and comprising valve means coupled to said inlet means for controlling the flow of water to said inner chamber.

7. A water gas furnace as in claim 4, and comprising a wall of insulation material provided about a periphery of said containment vessel.

8. A water gas furnace as in claim 7, and comprising a series of fluid conducting pipes embedded in said insulation material to provide a heat exchanger for extracting heat from the furnace.

9. A method of generating and utilizing water gas in a heat producing operation, comprising:

storing carbonaceous material in a housing;

providing a flow of water into a container positioned in the housing:

heating the carbonaceous material to convert the water into steam;

ejecting the steam from the container into the heated carbonaceous material;

passing air into the heated carbonaceous material to produce oxygen and hydrogen gases to define a water gas caused by a combustible reaction of the carbonaceous material with the steam and the air;

providing iron means having a form of a cylinder of sheet steel about the carbonaceous material to provide a catalyst for disassociation of the oxygen and hydrogen gases so that said iron means absorbs the oxygen gas to free the hydrogen gas to burn as a fuel within the housing; and extracting the heat produced.

10. A method as in claim 9, and comprising the steps of passing the hydrogen gas into a pumiceous material which accepts the hydrogen gas into its pores, and igniting the hydrogen gas in the pumiceous material to produce heat from the combustion of the hydrogen gas.

11. A method as in claim 9, and further comprising the step of metering the flow of water into the container.

12. A method of generating and utilizing water gas in a heat producing operation, comprising:

storing carbonaceous material in a housing;

providing a flow of water into a container positioned in the housing:

heating the carbonaceous material to convert the water into steam;

ejecting the steam from the container into the heated carbonaceous material;

passing air into the heated carbonaceous material to produce oxygen and hydrogen gases to define a water gas caused by a combustible reaction of the carbonaceous material with the steam and the air;

storing a pumiceous material above the carbonaceous material, whereby the hydrogen gas rising from the carbonaceous material enters the pumiceous material, and whereby the pumiceous material drops down as the carbonaceous material is used up to thereby continue heating the hydrogen gas in the housing;

providing iron means having a form of a cylinder of sheet steel about the carbonaceous material to provide a catalyst for disassociation of the oxygen and hydrogen gases so that said iron means absorbs the oxygen gas to free the hydrogen gas to burn as a fuel within the housing;

passing the hydrogen gas into the pumiceous material which accepts the hydrogen gas into its pores, and igniting the hydrogen gas in the pumiceous material to produce heat from the combustion of the hydrogen gas; and extracting the heat produced.

* * * * *